US009433269B2

(12) United States Patent
Ma

(10) Patent No.: US 9,433,269 B2
(45) Date of Patent: Sep. 6, 2016

(54) QUICK ASSEMBLY METHODS AND COMPONENTS FOR SHADE STRUCTURES

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 61 days.

(21) Appl. No.: 14/189,822

(22) Filed: Feb. 25, 2014

(65) Prior Publication Data

US 2015/0237977 A1 Aug. 27, 2015

(51) Int. Cl.
*A45B 25/10* (2006.01)

(52) U.S. Cl.
CPC ..... *A45B 25/10* (2013.01); *Y10T 29/40* (2015.01)

(58) Field of Classification Search
CPC ..... A45B 25/02; A45B 25/06; A45B 25/10; Y10T 403/44; Y10T 403/55; Y10T 403/4949; Y10T 403/7123
USPC ..... 135/28–30, 98; 403/171–173, 217–219; 29/25
See application file for complete search history.

(56) References Cited

U.S. PATENT DOCUMENTS

| | | | |
|---|---|---|---|
| 331,231 | A | 11/1885 | Folger |
| 501,089 | A | 7/1893 | Lichtenstein |
| 620,815 | A | 3/1899 | Warren |
| 750,178 | A | 1/1904 | Fesenfeld |
| 770,704 | A | 9/1904 | George Bishop Vogel |
| 847,805 | A | 3/1907 | McAvoy |
| 878,270 | A | 2/1908 | Blake et al. |
| 880,534 | A | 3/1908 | Hoyt |
| 897,026 | A | 8/1908 | Seitzinger |
| 928,169 | A | 7/1909 | Bardon |
| 941,952 | A | 11/1909 | Riehl |
| 947,790 | A | 2/1910 | Carter |
| 959,127 | A | 5/1910 | Edwards |

(Continued)

FOREIGN PATENT DOCUMENTS

| | | |
|---|---|---|
| CA | 1269018 | 5/1990 |
| DE | 1152226 | 8/1963 |

(Continued)

OTHER PUBLICATIONS

Extended European Search Report issued in EP Application No. 14157685, dated Jul. 7, 2014, in 8 pages.

(Continued)

*Primary Examiner* — Winnie Yip
(74) *Attorney, Agent, or Firm* — Knobbe, Martens, Olson & Bear, LLP

(57) ABSTRACT

An umbrella assembly is provided that comprises an umbrella hub comprising an upper portion, a lower portion and a passage configured to be disposed about an umbrella pole. The upper portion includes a top surface that extends between the passage and an outer periphery of the hub. The lower portion includes a bottom surface that extends between the passage and the outer periphery of the hub. The umbrella hub also includes a first engagement position and a second engagement position. The first engagement position is configured to permit insertion of end portions of umbrella structural members into the hub. The first engagement position is provided by first relative movement of the upper and lower portions of the hub along an axis extending through the passage. The second engagement position is configured to retain end portions of umbrella structural members within the hub. The second engagement position is provided by second relative movement of the upper and lower portions of the hub along an axis extending through the passage.

27 Claims, 10 Drawing Sheets

(56) References Cited

U.S. PATENT DOCUMENTS

| | | | | |
|---|---|---|---|---|
| 1,001,076 | A | 8/1911 | Redford | |
| 1,022,944 | A | 4/1912 | Hodinger | |
| 1,078,069 | A | 11/1913 | Simons | |
| 1,107,415 | A | 8/1914 | Drohan | |
| 1,264,075 | A | 4/1918 | Hout | |
| 1,469,495 | A | 10/1923 | Bunker | |
| 1,808,610 | A | 6/1931 | Roy | |
| 2,101,510 | A | 12/1937 | Rathbun | |
| 2,207,043 | A | 7/1940 | Weiss et al. | |
| 2,321,495 | A | 6/1943 | Levin | |
| 2,336,116 | A | 12/1943 | Morando | |
| 2,385,575 | A | 9/1945 | Isler | |
| 2,469,637 | A | 5/1949 | Evans, Wayne S. et al. | |
| 2,635,616 | A | 4/1953 | Haydu | |
| 2,762,383 | A | 9/1956 | Wittman | |
| 2,796,073 | A | 6/1957 | Wittman | |
| 2,860,647 | A | 11/1958 | Negri | |
| 2,914,154 | A | 11/1959 | Russell | |
| 3,177,882 | A | 4/1965 | Vincent | |
| 3,424,180 | A | 4/1966 | Andolfi | |
| 3,252,468 | A * | 5/1966 | Militano | 135/28 |
| 3,330,582 | A | 7/1967 | Morris | |
| 3,462,179 | A | 8/1969 | Hinkle | |
| 3,557,809 | A | 1/1971 | Vazquez et al. | |
| 3,643,673 | A | 2/1972 | Weber | |
| 3,704,479 | A | 12/1972 | Whitaker | |
| 4,201,237 | A | 5/1980 | Watts et al. | |
| 4,368,749 | A | 1/1983 | Lindler et al. | |
| 4,369,000 | A | 1/1983 | Egnew | |
| 4,627,210 | A | 12/1986 | Beaulieu | |
| 4,673,308 | A | 6/1987 | Reilly | |
| 4,750,509 | A | 6/1988 | Kim | |
| 4,941,499 | A | 7/1990 | Pelsue et al. | |
| 4,966,178 | A * | 10/1990 | Eichhorn | E04H 15/28 135/123 |
| D320,111 | S | 9/1991 | Ma | |
| 5,056,291 | A | 10/1991 | Leung | |
| 5,069,572 | A | 12/1991 | Niksic | |
| 5,085,239 | A | 2/1992 | Chin-Hung et al. | |
| 5,188,137 | A | 2/1993 | Simonelli | |
| 5,193,566 | A | 3/1993 | Chen | |
| 5,328,286 | A | 7/1994 | Lee | |
| 5,433,233 | A | 7/1995 | Shiran et al. | |
| 5,445,471 | A | 8/1995 | Wexler et al. | |
| 5,738,129 | A | 4/1998 | Vogt | |
| 5,740,824 | A | 4/1998 | Tang | |
| 5,797,613 | A | 8/1998 | Busby | |
| 5,797,695 | A | 8/1998 | Prusmack | |
| 5,842,494 | A * | 12/1998 | Wu | 135/33.41 |
| 5,911,233 | A | 6/1999 | Wu | |
| 6,076,540 | A | 6/2000 | You | |
| 6,095,169 | A | 8/2000 | Lin et al. | |
| 6,199,572 | B1 * | 3/2001 | Rousselle et al. | 135/128 |
| 6,311,706 | B1 | 11/2001 | Sato | |
| 6,314,976 | B1 | 11/2001 | Clarke | |
| 6,332,657 | B1 | 12/2001 | Fischer | |
| 6,345,637 | B1 | 2/2002 | Ko | |
| 6,354,316 | B1 | 3/2002 | Chen | |
| 6,374,840 | B1 | 4/2002 | Ma | |
| 6,386,215 | B1 | 5/2002 | Chang | |
| 6,397,867 | B2 | 6/2002 | You | |
| 6,604,844 | B2 | 8/2003 | Hussey | |
| 6,643,889 | B1 | 11/2003 | Kotlarski | |
| 6,701,946 | B2 | 3/2004 | You | |
| 6,705,335 | B2 | 3/2004 | You | |
| 6,758,228 | B1 | 7/2004 | You | |
| 6,814,093 | B2 | 11/2004 | You | |
| 7,178,535 | B2 | 2/2007 | Eder | |
| 7,464,503 | B2 | 12/2008 | Hoberman | |
| 7,481,235 | B2 | 1/2009 | Prusmack | |
| 7,547,777 | B2 | 6/2009 | Tokumaru et al. | |
| 7,703,464 | B2 | 4/2010 | Ma | |
| 7,891,367 | B2 * | 2/2011 | Ma | 135/19.5 |
| 8,061,375 | B2 | 11/2011 | Ma | |
| 8,069,872 | B2 | 12/2011 | Bae | |
| 8,082,935 | B2 | 12/2011 | Ma | |
| 8,082,937 | B2 * | 12/2011 | Tarter et al. | 135/91 |
| 8,166,986 | B2 | 5/2012 | Ma | |
| 8,360,085 | B2 * | 1/2013 | Lee | 135/135 |
| 8,485,208 | B2 | 7/2013 | Seo | |
| 8,496,019 | B2 * | 7/2013 | Zhou | 135/135 |
| 2001/0007260 | A1 * | 7/2001 | Rousselle et al. | 135/98 |
| 2004/0123891 | A1 | 7/2004 | Ma | |
| 2005/0115599 | A1 | 6/2005 | You | |
| 2006/0124160 | A1 | 6/2006 | Lee | |
| 2007/0172310 | A1 | 7/2007 | Yang et al. | |
| 2009/0126769 | A1 | 5/2009 | Hoogendoorn | |
| 2009/0260664 | A1 | 10/2009 | Ma | |
| 2011/0017249 | A1 | 1/2011 | Ma | |
| 2012/0318316 | A1 | 12/2012 | Choi et al. | |
| 2013/0008478 | A1 * | 1/2013 | Prieto Estebanez | 135/147 |
| 2013/0276843 | A1 | 10/2013 | Ma | |

FOREIGN PATENT DOCUMENTS

| | | |
|---|---|---|
| EP | 0202769 | 12/1989 |
| FR | 855628 | 5/1940 |
| FR | 002650491 | 2/1991 |
| FR | 2857835 | 1/2005 |
| GB | 2113543 | 8/1983 |
| GB | 2165448 | 11/1987 |
| JP | 61131921 | 8/1986 |
| KR | 100851744 | 8/2008 |
| WO | WO 2005/023042 | 3/2005 |

OTHER PUBLICATIONS

Extended European Search Report issued in EP Application No. 14158057, dated Jul. 7, 2014, in 7 pages.

U.S. Appl. No. 13/783,958, filed Mar. 4, 2013, Ma.

U.S. Appl. No. 13/787,601, filed Mar. 6, 2013, Ma.

EPO Extended Search Report dated Apr. 5, 2011 for European Patent No. 09252140.0, filed Sep. 7, 2009.

Treasure Garden, 2010 Products Catalog, pp. 20 and 60.

Extended European Search Report issued in EP Application No. 15156587.6, dated Jul. 23, 2015, in 7 pages.

Final Office Action issued in U.S. Appl. No. 13/797,477, dated Sep. 17, 2015, in 10 pages.

* cited by examiner

QUICK ASSEMBLY METHODS AND COMPONENTS FOR SHADE STRUCTURES

BACKGROUND OF THE INVENTIONS

1. Field of the Invention

This application relates to apparatuses and methods that facilitate efficient assembly of ribs and hubs of umbrellas and other structures with a plurality of elongate structural members that extend from a central hub member.

2. Description of the Related Art

Larger umbrellas, such as market umbrellas, generally include a frame-like structure that is used to support and distribute the weight of an upper portion of the umbrella as well as to enable the umbrella to be opened and closed as desired by the user. The frame-like structure of such umbrellas can take various forms, but often includes one or more hubs connected with a plurality of movable structural members.

Prior art methods of assembly of umbrella hubs and ribs are labor intensive. The process involves inserting a pin through an end portion of each rib of a set of ribs, positioning all of the rib ends in a lower portion of a hub, and then placing an upper portion of the hub over the rib ends so positioned. Finally, screws are advanced through upper and lower hub portions to attach the upper portion to the lower portion of the hub. While achieving the result of assembling the hub and ribs, this process is tedious and sometimes requires rework, for example if the ends of any of the ribs become misaligned before the upper hub portion is attached to the lower hub portion.

SUMMARY OF THE INVENTIONS

It would be beneficial to provide structures that enable quicker and less labor intensive assembly of umbrella assemblies, e.g., rib and hub assemblies. An aspect of at least one of the embodiments disclosed herein is the realization that connection devices used in the assembly of shade structures, such as pavilions and outdoor umbrellas, can be improved to provide a more secure, quicker, and more reliable connection. Such devices can be advantageously configured with fewer parts, making them easier to manufacture than devices in the prior art. Such improved connection devices can be particularly advantageous for large shade structures.

Another aspect of at least one embodiment disclosed herein is the realization that prior art umbrella hubs or hub assemblies include an excessive amount of individual components. For example, individual pins are often individually placed into a portion of the hub before portions of the hub are carefully assembled. This tedious manufacturing can be costly and frustrating. Therefore, embodiments disclosed herein seek to remedy this deficiency by providing a hub assembly that uses a reduced number of parts. Accordingly, the time and cost required for manufacturing the hub can be greatly decreased.

Another aspect of at least one of the embodiments disclosed herein is the realization that while some devices have been suggested to expedite assembly, such devices have been inadequate, for example lacking the ability to bear a full range of operational loads, which can be much higher than the weight of the components of the shade structure, particularly in windy conditions. As such, the members of a frame of a shade structure should be quickly, securely, and firmly interconnected so that the frame can properly support not only the weight of the various structural members and the canopy, but also the stresses and other forces that are common or possible during the use of such structures.

In one aspect, an umbrella assembly is provided that comprises an umbrella hub comprising an upper portion, a lower portion and a passage configured to be disposed about an umbrella pole. The upper portion includes a top surface that extends between the passage and an outer periphery of the hub. The lower portion includes a bottom surface that extends between the passage and the outer periphery of the hub. The umbrella hub also includes a first engagement position and a second engagement position. The first engagement position is configured to permit insertion of end portions of umbrella structural members into the hub. The first engagement position is provided by first relative movement of the upper and lower portions of the hub along an axis extending through the passage. The second engagement position is configured to retain end portions of umbrella structural members within the hub. The second engagement position is provided by second relative movement of the upper and lower portions of the hub along an axis extending through the passage.

In another aspect, an umbrella hub is provided that includes an upper portion, a lower portion, and a snap-together coupling. The upper portion includes a top surface that extends toward an outer periphery of the hub. The lower portion includes a bottom surface that extends toward the outer periphery of the hub. The snap-together coupling comprises a cantilever member that extends from one of the upper and lower portions across an interface between the upper and lower portions. The snap-together coupling comprising a plurality of recesses disposed on the other of the upper and lower portions. The cantilever member has a lateral portion adjacent to a free end thereof. The recesses are configured to receive the lateral portion of the cantilever member to define at least one of a partial assembly configuration and a full assembly configuration.

In another aspect, an umbrella hub assembly is provided that has a plurality of elongate ribs and a hub assembly. Each of the ribs has an inner end, an outer end, and a body extending therebetween along a longitudinal axis. The inner end has a transverse pivot member extending away from the longitudinal axis. The hub assembly includes an upper portion, a lower portion, and a rib end coupler. The upper portion has a lower surface partially defining a hub interface. The lower portion has an upper surface partially defining the hub interface. The rib end coupler, which is disposed at the hub interface, comprises a deflectable member and a retainer. The deflectable member is configured to be deflected to receive the transverse pivot member of one of the ribs in a first configuration of the rib end coupler. The retainer is configured to receive the deflectable member in a second configuration of the rib end coupler. In the first configuration of the rib end coupler, the upper and lower portions are coupled together and the retainer is disposed away from the deflectable member such that the deflectable member can be deflected in a first direction to permit the transverse pivot member to move into a coupled position. In the second configuration, the upper and lower portions are coupled together and the retainer is disposed immediately adjacent to the deflectable member such that the retainer prevents the deflectable member from being deflected in the first direction by an amount sufficient to permit the transverse pivot member to move out of the coupled position.

In another embodiment, a method of assembling umbrella components is provided. In the method, a first portion of an umbrella hub is advanced toward a second portion of the umbrella hub to a first position in which the first and second portions of the umbrella hub are engaged for assembly. An end of a rib is inserted laterally into an engagement portion of the hub to dispose a pivot member of the end of the rib adjacent a rib end coupler. The rib end coupler is actuated to permit the pivot member to be advanced into the rib end coupler. The first portion of the umbrella hub is locked to the second portion of the umbrella hub to retain the pivot member in the rib end coupler.

Various embodiments can broadly encompass an umbrella hub with a plurality of assembly position, which can retain multiple portions of the umbrella hub engaged together for assembly purposes. For example, the portions can be held close together but with a gap permitting pivot member of ribs to be advanced through a gap between the portions. This facilitates assembly because the ends of the ribs will be at least partially retained. Also, the portions of the hub can retain their relative position without the assembler having to hold them together in an assembly position. Thereafter, the hub can be fully coupled in another position, which may be referred to as a fully assembled or a locked position. In this position, the rib ends (and pivots disposed therein) can be held securely enough to withstand normal operational loads and a full duty cycle.

In other broad aspects, hub assembly includes novel locking components that facilitate snap-together assembly of the hub. The locking components can include mating protrusions and recesses. The locking components can include one or more tapered posts that can project across an interface zone between multiple, e.g., two hub components. One or more tapered recesses can be provided to receive the tapered posts. Deflection of one or both of the posts and recesses can enable positioning of the tapered post in the recesses to provide locking of the hub portions. In one arrangement, deflection of the recess can be enabled by one or more slits or other structure enhancing the deformation in or deformability of a wall adjacent to the recess. In certain cases, the tapered posts and recesses provide a robust connection between hub components in at least one of a partially and fully assembled configuration.

Certain embodiments have one or more cantilevered hooks that project across an interface zone between multiple, e.g., two hub components. The cantilever hook(s) and mating recess(es) provide one or more secure couplings between the hub portions. In some cases, each hook includes a plurality of recesses where each recesses defines a discrete configuration for assembly and/or operation.

In certain embodiments, the locking components can be of different types, e.g., can include at least one deflectable hook and recess coupling and at least one tapered post and narrow passage coupling.

Various innovative methods of manufacture also arise from the disclosure herein. In particular, a hub can be partially assembled with a snap-together process. Thereafter, rib ends can be inserted into a retained configuration within the hub. This permits each of a plurality, e.g., two, three, four, five, six, seven, or eight or more ribs to be sequentially assembled. When all ribs are in place and confirmed to be properly assembled the hub can be fully assembled, e.g., locked together, such that the rib ends are retained during final assembly and operation of the umbrella. Past methods involved placing all ribs on a portion of a hub before coupling a second portion over the rib ends. While this worked, it could be inefficient and required great care because the partial assembly could be disrupted requiring extensive re-work.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No aspects of this disclosure are essential or indispensable.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

In accordance with embodiments described herein, there are provided various configurations of a hub and hub assembly that can be used with an umbrella support structure, such as an umbrella or pavilion, to facilitate the rapid and secure fastening of structural ribs with a hub or other structure. As described in greater detail herein, the hub and hub assembly can incorporate various features such that a secure connection with a structure, such as a mounting member of a hub of an umbrella, can be obtained. Additional details and features of related umbrella rib connectors and assemblies are illustrated and described in Applicant's U.S. Pat. No. 7,703,464, issued Apr. 27, 2010, entitled and in Applicant's U.S. Pat. No. 7,891,367, issued Feb. 22, 2011, entitled the entirety of the contents of both of which are incorporated herein by reference.

Figure 1:
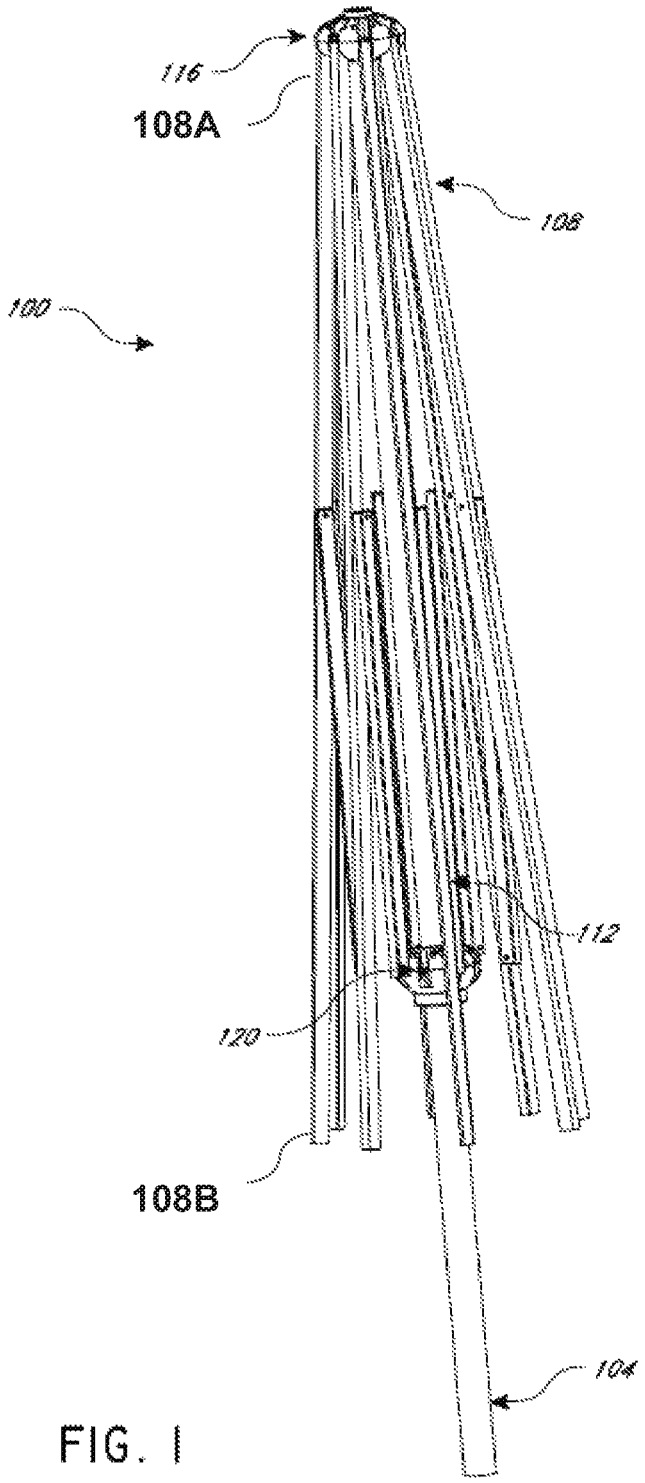
FIG. 1 is a side elevation view of an umbrella assembly including upper and lower hubs disposed about an umbrella pole and a plurality of umbrella ribs and struts extending therefrom, according to one embodiment.

FIG. 1 shows an umbrella assembly 100 that includes an umbrella hub assembly 116. The hub assembly 116 is configured for excellent manufacturability and also for efficient use of components, such as reducing the number of components. The umbrella assembly 100 includes a lower hub 120 and an upper hub 124. Although the umbrella hub assembly 116 is described in connection with the upper hub 124 it is to be understood that feature of the umbrella hub assembly 116 can also be used or provided with the lower hub 120 or with intermediate hubs (not shown).

Figure 4:
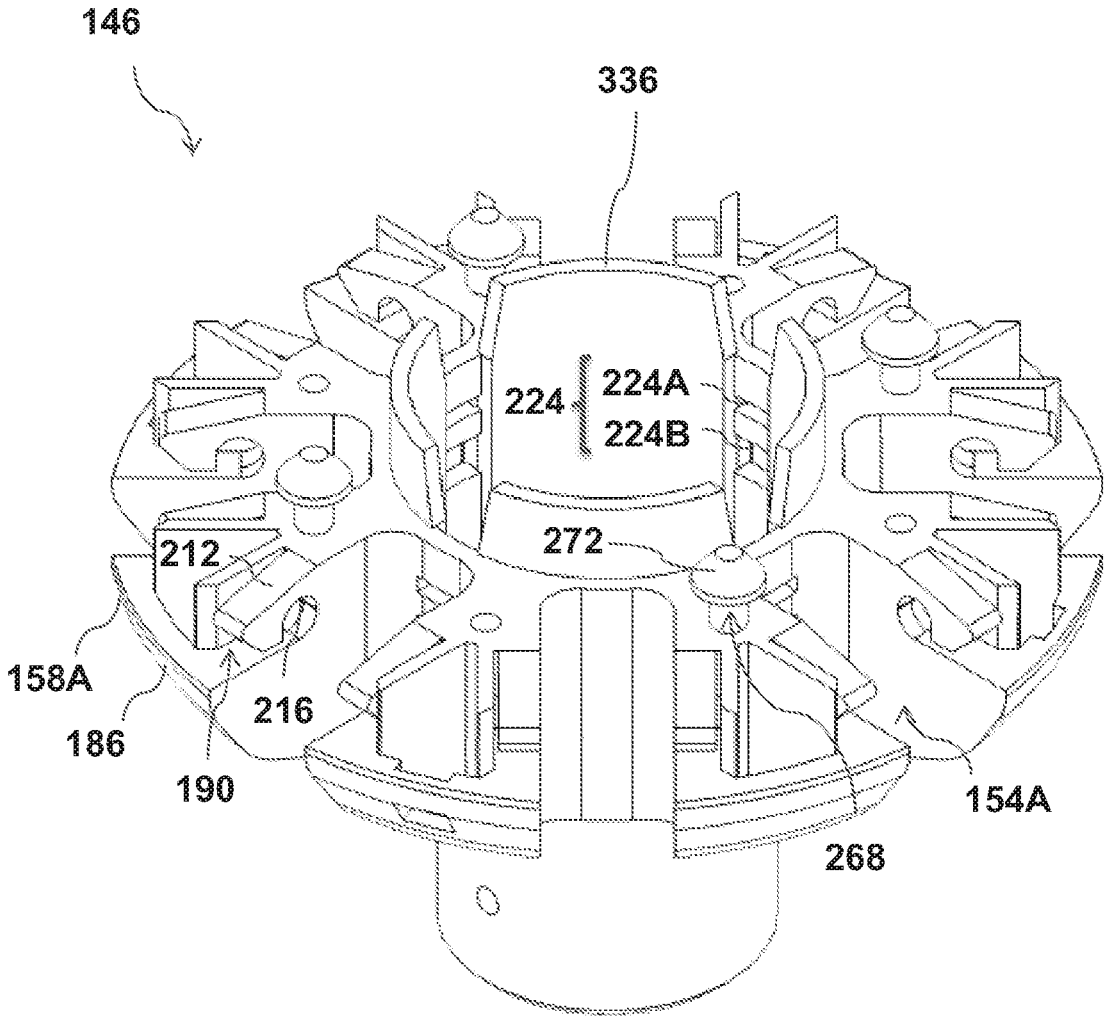
FIG. 4 is a top perspective view of a lower portion of the hub assembly shown in FIG. 2.

FIG. 1 also shows that that the umbrella assembly 100 can include a plurality of structural members, e.g., including ribs 108 and struts 112. Each of the ribs 108 has an inner end 108A, an outer end 108B, and a body extending along a longitudinal axis therebetween. The inner end 108A has a transverse pivot member 108C (see FIGS. 8-11) that extends away from the longitudinal axis. Details of the inner end 108A and the pivot member 108C are shown in FIGS. 4 and 8 and are discussed further below.

Figure 2:
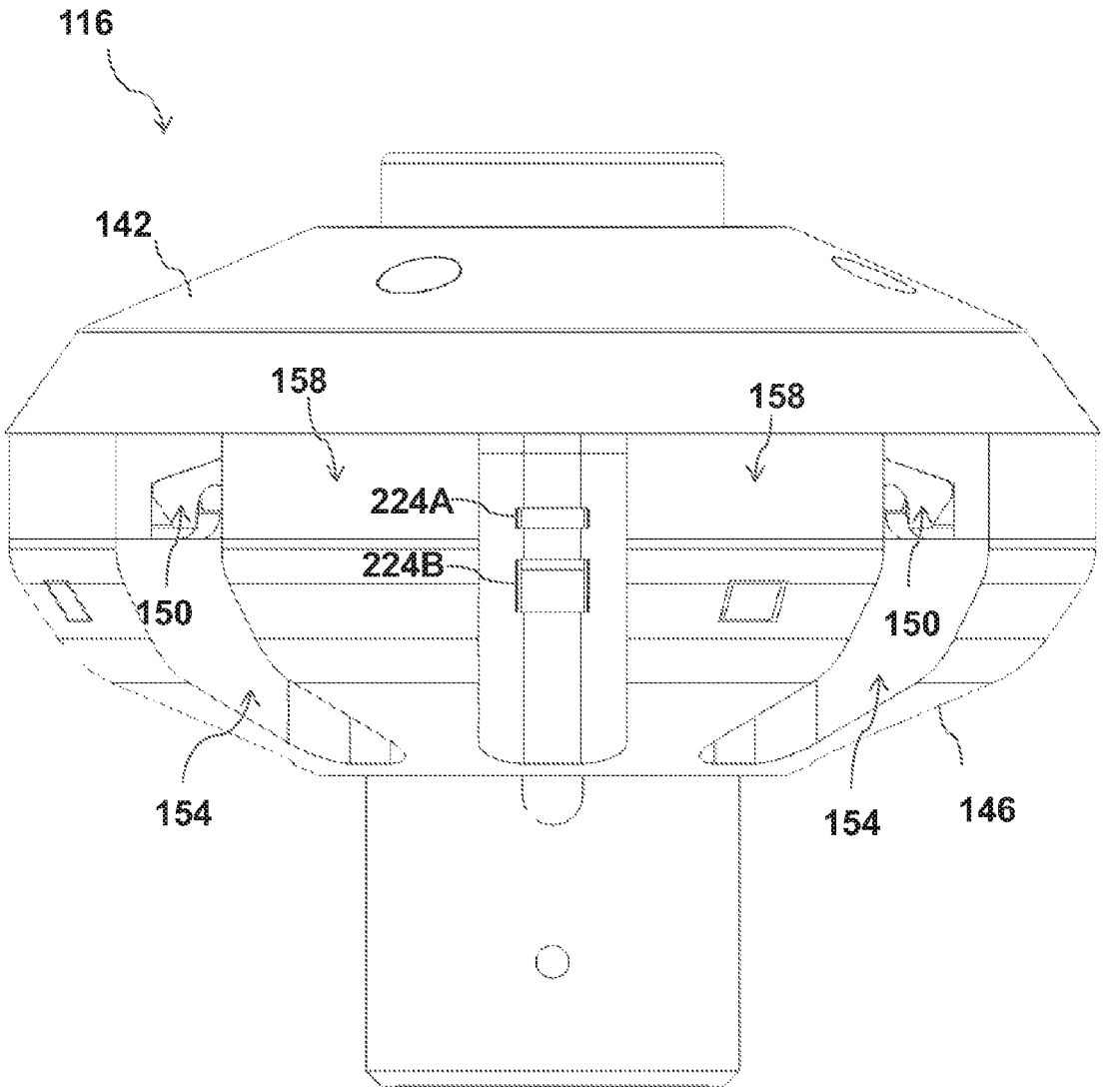
FIG. 2 is a side elevation view of the upper hub illustrated in FIG. 1.
Figure 3:
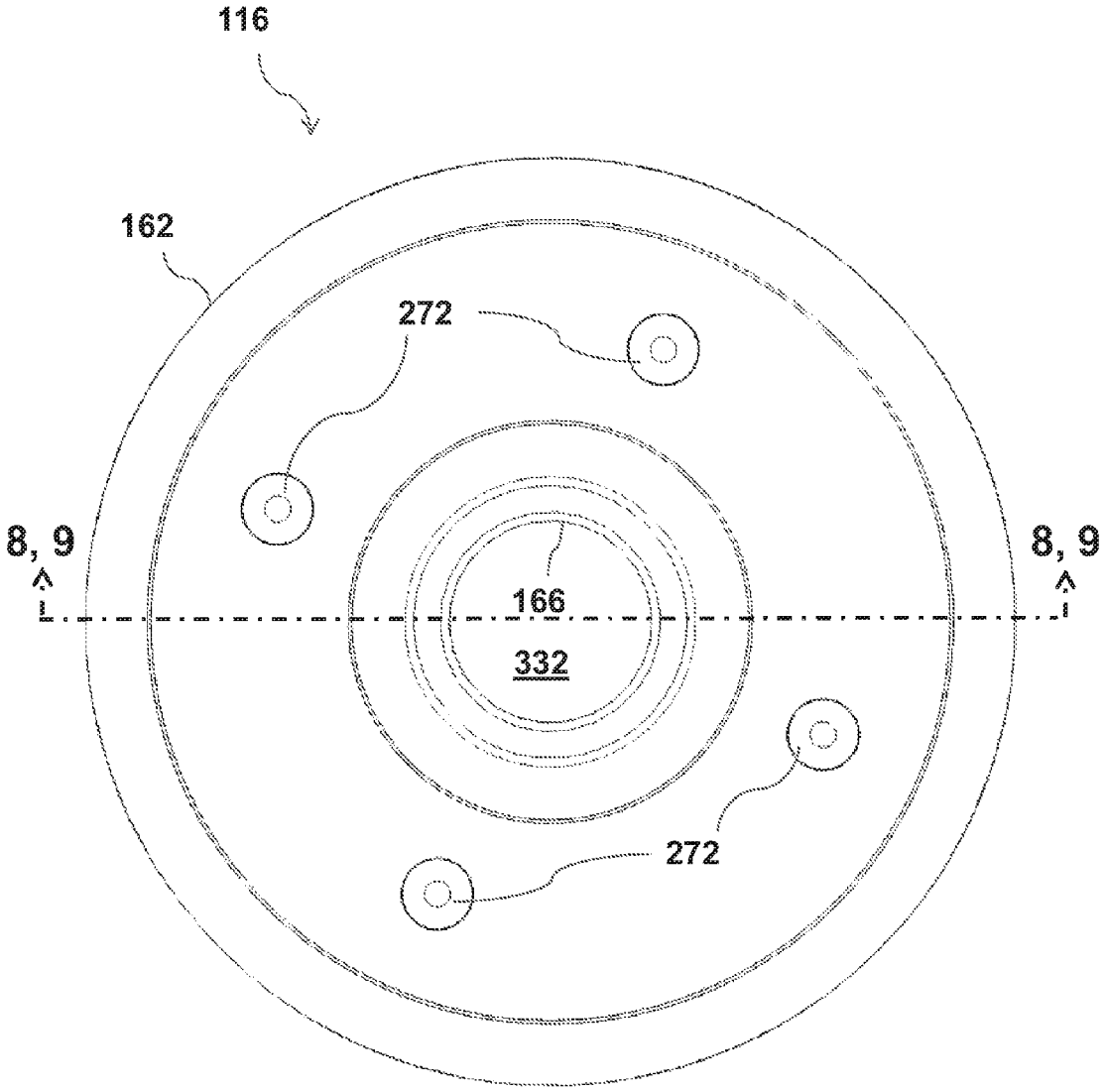
FIG. 3 is a top view of the upper hub assembly of FIG. 2.
Figure 5:
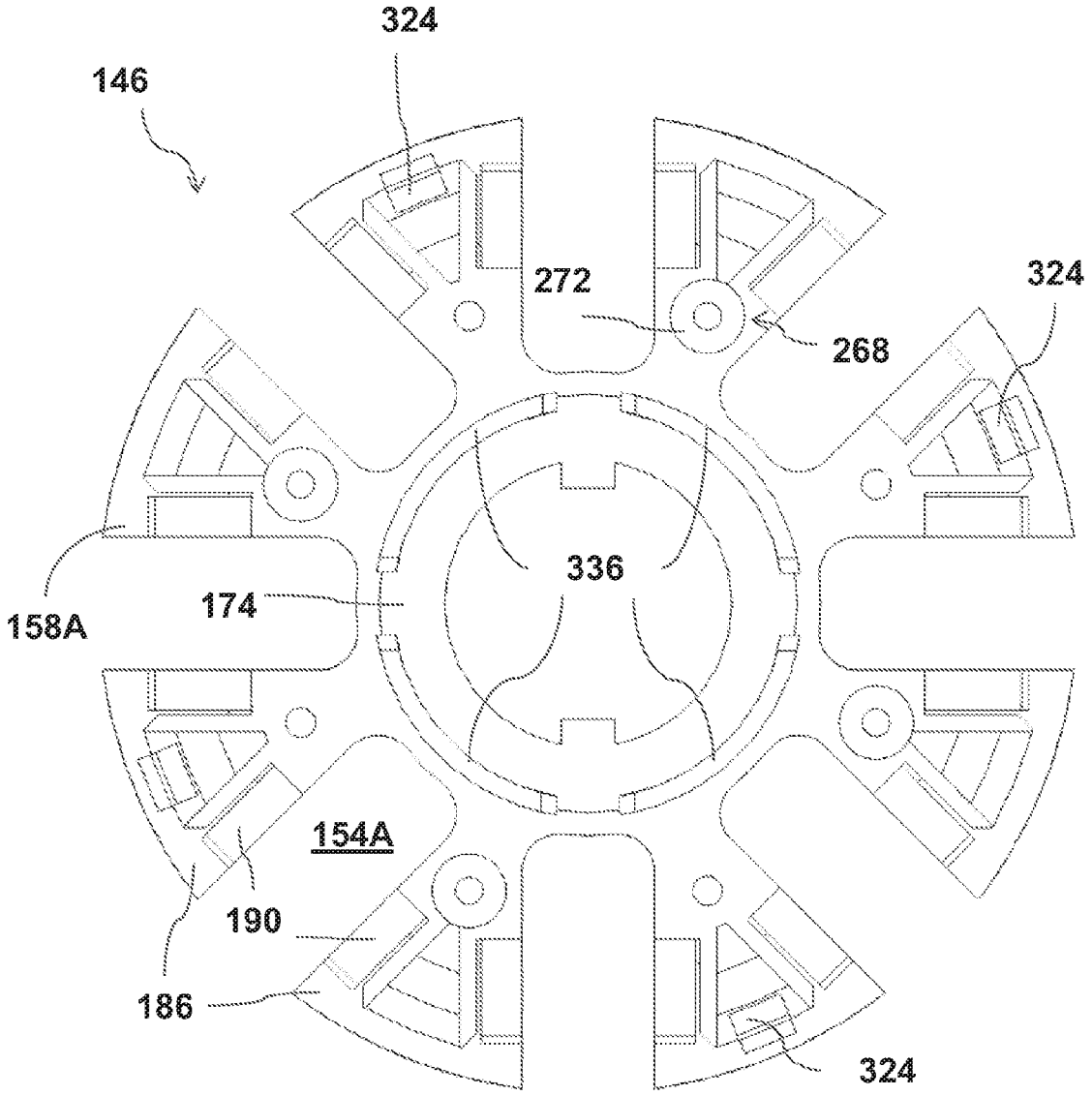
FIG. 5 is top view of the lower portion of FIG. 4.
Figure 7:
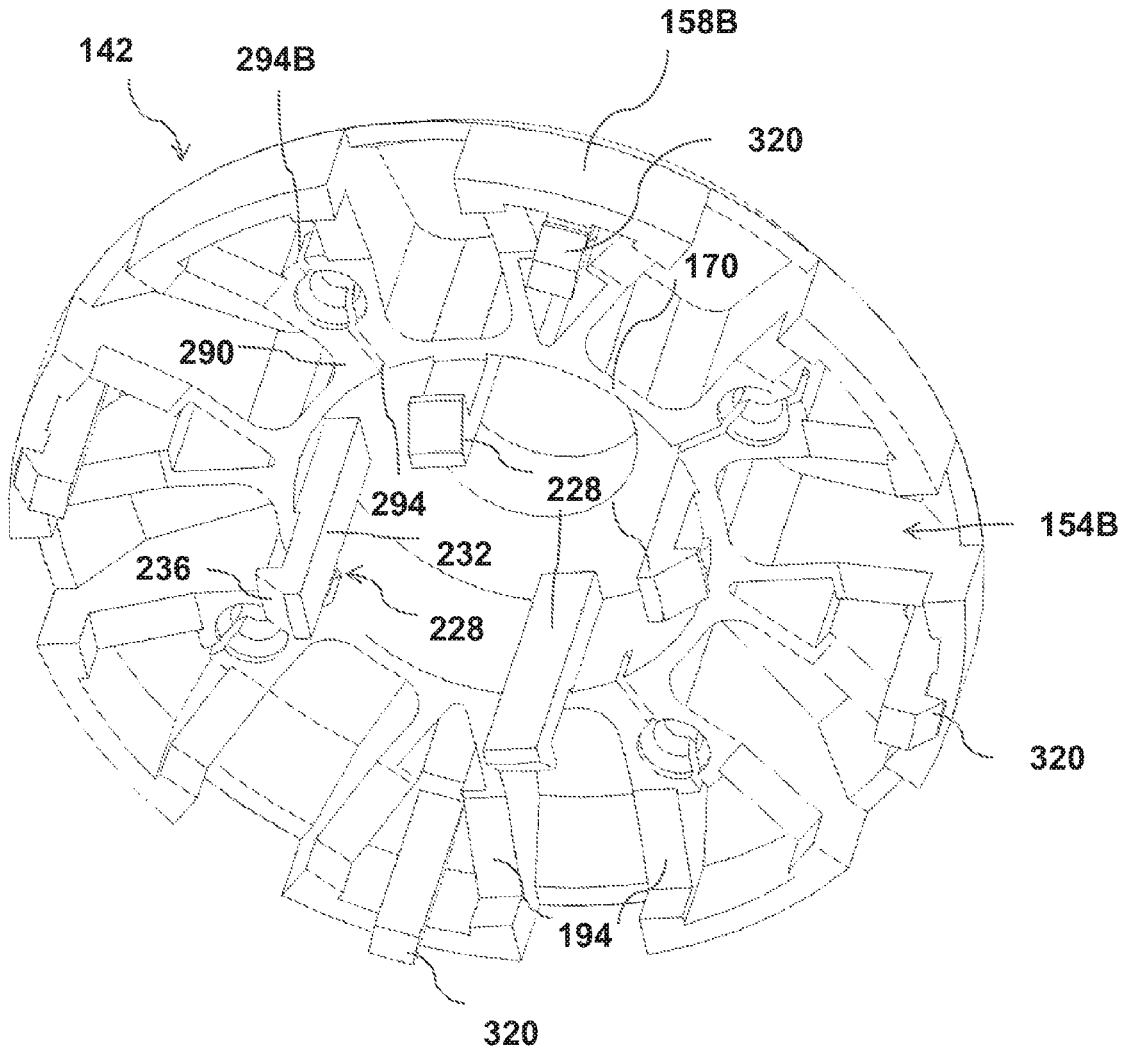
FIG. 7 is a bottom perspective view of the upper portion of the hub shown in FIG. 2.

FIG. 2 shows the hub assembly 116 in greater detail. The hub assembly 116 includes an upper portion 142, a lower portion 146, and a rib end coupler 150. As discussed in greater detail below, the rib end coupler 150 is disposed along each of a plurality of engagement sections 154 disposed around the hub assembly 116. The engagement sections 154 can comprise channels that are open at radially outer positions of the hub assembly 116 and that are closed at radially inner portions and side portions of the hub assembly 116. Thus each of the engagement sections 154 enables the inner end 108A of a corresponding rib to swing freely in the engagement section. The engagement sections 154 can be disposed between adjacent projections 158 that extend radially between an outer periphery 162 and an inner periphery 166 of the hub assembly 116. In one embodiment, the engagement sections 154 are primarily formed on the lower hub portion 146. In one embodiment, the engagement sections 154 comprise a lower portion 154A bounded by the lower hub portion 146 and an upper portion 154B bounded by the upper hub portion 146. In one embodiment, the projections 158 comprise a lower portion 158A adjacent to the lower portion 154A of the engagement section 154 and an upper portion 158B adjacent to the upper hub portion 154B of the engagement section. FIGS. 5 and 7 show that the engagement sections 154 and projections 158 can be disposed symmetrically around a central body 170 of the upper portion 142 and about a central body 174 of the lower portion 146. In one embodiment, there are eight engagement sections 154 and eight projections 158.

The upper portion 142 has a lower surface partially defining a hub interface 182. The lower portion 146 has an upper surface 186 partially defining the hub interface 182. The rib end coupler 150 is disposed at the hub interface 18 and comprises a deflectable member 190 and a retainer 194. The deflectable member 190 is configured to be deflected to receive the transverse pivot member 108C of one of the ribs 108 in a first configuration of the rib end coupler 150. FIG. 8 illustrates this in greater detail. The deflectable member 190 can comprise an extension of the lower portion 158A of the projection 158. The deflectable member 190 can be configured to have a fixed end 204 coupled with (e.g., a monolithic or continuous extension of) the lower portion 158A. The deflectable member 190 can comprise a free end 208 disposed away from the fixed end 204. The free end 208 can include a radially outward inclined surface that is configured to be engaged by the pivot member 108C during assembly. The inclined surface can have a height (e.g., dimension normal to the surface 186) that is about the same as or greater than the diameter of the pivot member 108C. This allow the pivot member 108C to be received between the inclined surface of the deflectable member 190 and the surface 186 such that inward movement of the pivot member 108C applies a lifting force to the free end 208 of the deflectable member 190.

Figure 8:
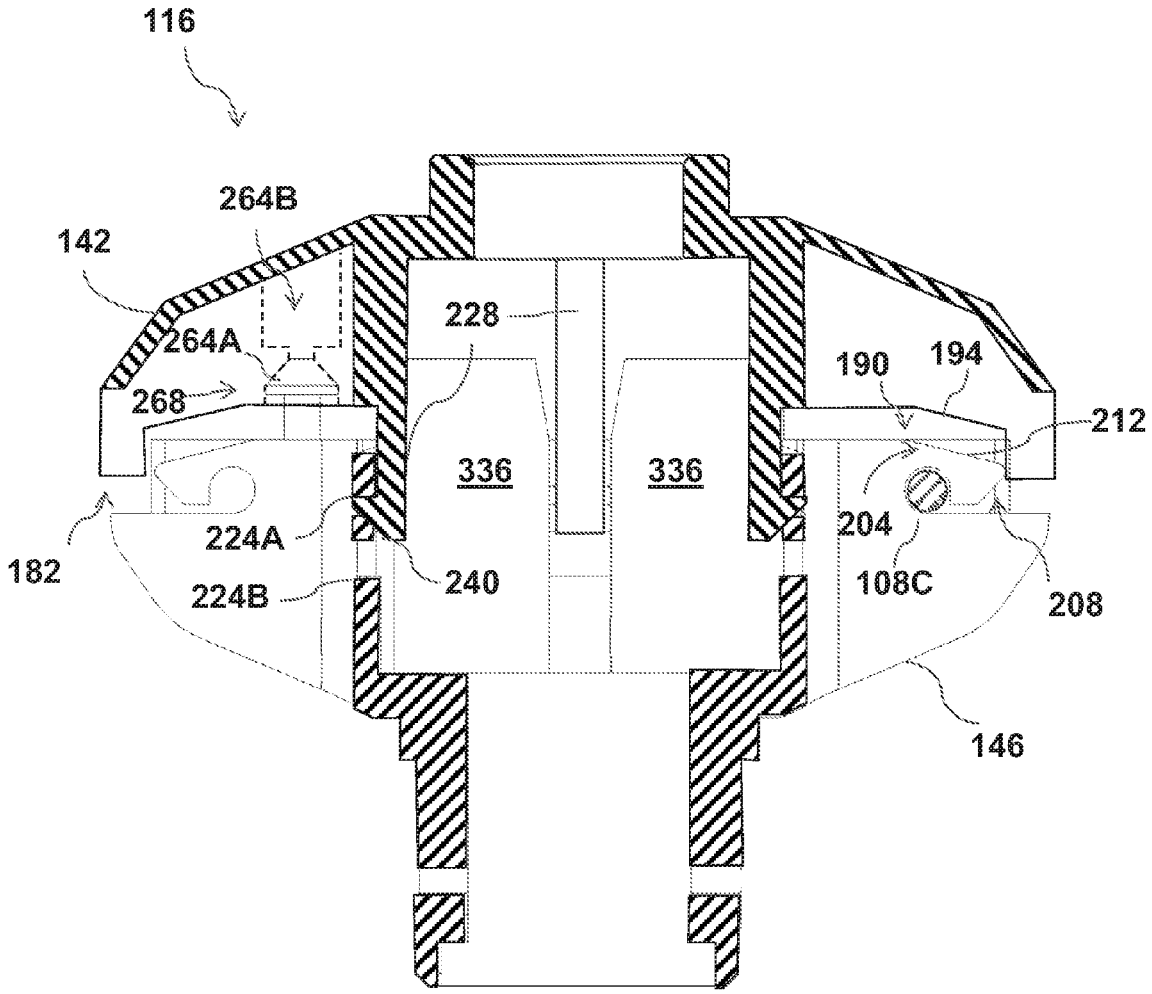
FIG. 8 is a cross-sectional view taken at section plane 8-8 illustrating a first assembly position of the lower hub portion of FIG. 4 relative to the upper hub portion of FIG. 6.

FIG. 8 illustrates a first, e.g., partially assembled, configuration of the hub assembly 116 in which the retainer 194 is disposed above the deflectable member 190. In this position, the retainer 194 can be spaced from the deflectable member 190 by a distance sufficient to permit the pivot member 108C to pass between the deflectable member 190 and the surface 186. For instance, the distance may be greater than the diameter of the pivot member 108C. In some cases, a clearance is provided between the deflectable member 190 and the surface 186. In such cases, the retainer 194 can be spaced from the deflectable member 190 by a distance greater than the diameter of the pivot member 108C excluding such clearance. Preferably the deflectable member 190 also has a mating surface 212 and a pivot facing surface 216 (See FIG. 4). The pivot facing surface 216 surrounds at least a portion of the pivot member 108C when the pivot member is disposed in the hub assembly 116. The pivot facing surface 216 is disposed between the mating surface 212 and the surface 186, which is a part of the interface 182 between the upper and lower portions 142, 146.

Figure 9:
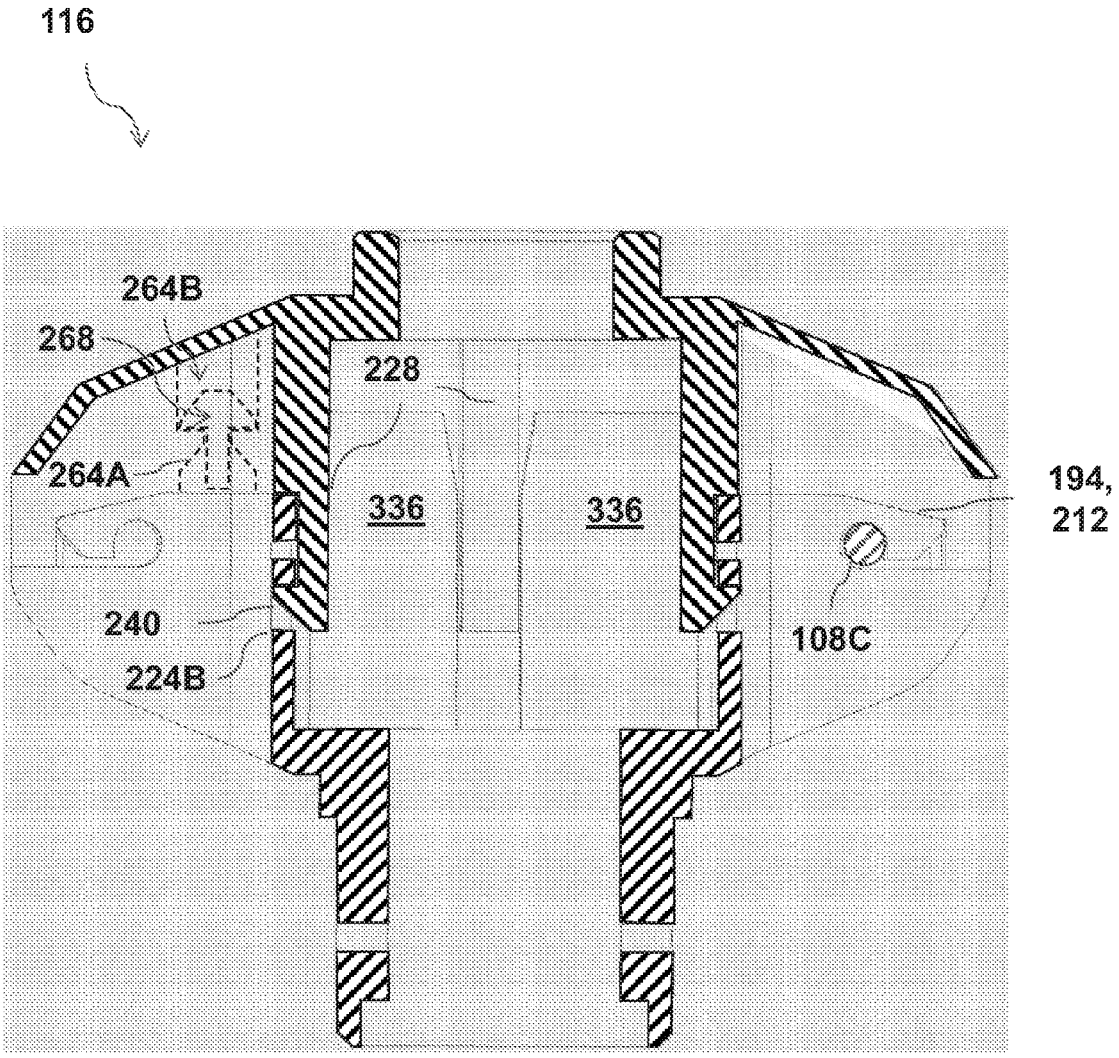
FIG. 9 is a cross-sectional view taken at section plan 8-8 illustrating a second assembly position of the lower hub portion of FIG. 4 relative to the upper hub portion of FIG. 6.
Figure 10:
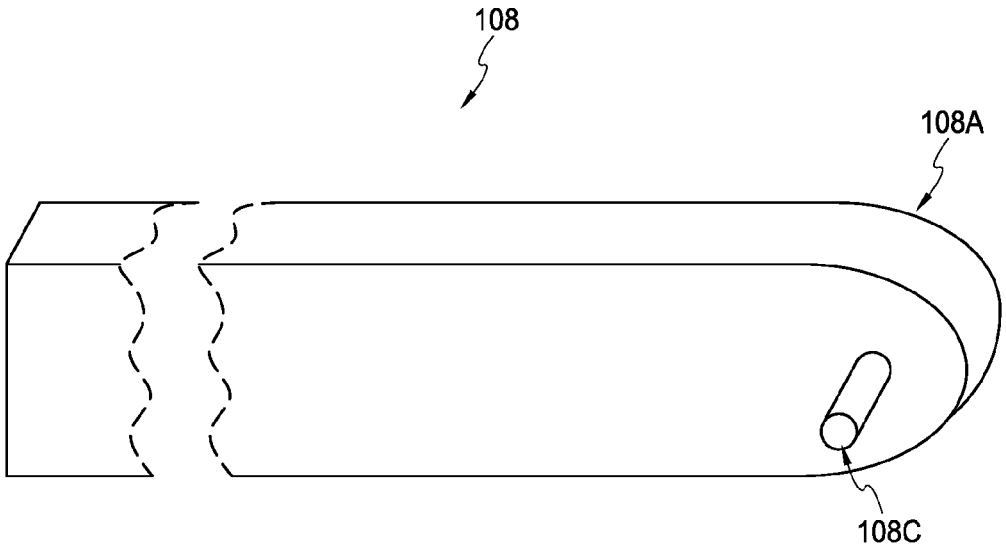
FIG. 10 is a detail perpective view of the end of a rib as shown in FIG. 1.
Figure 11:
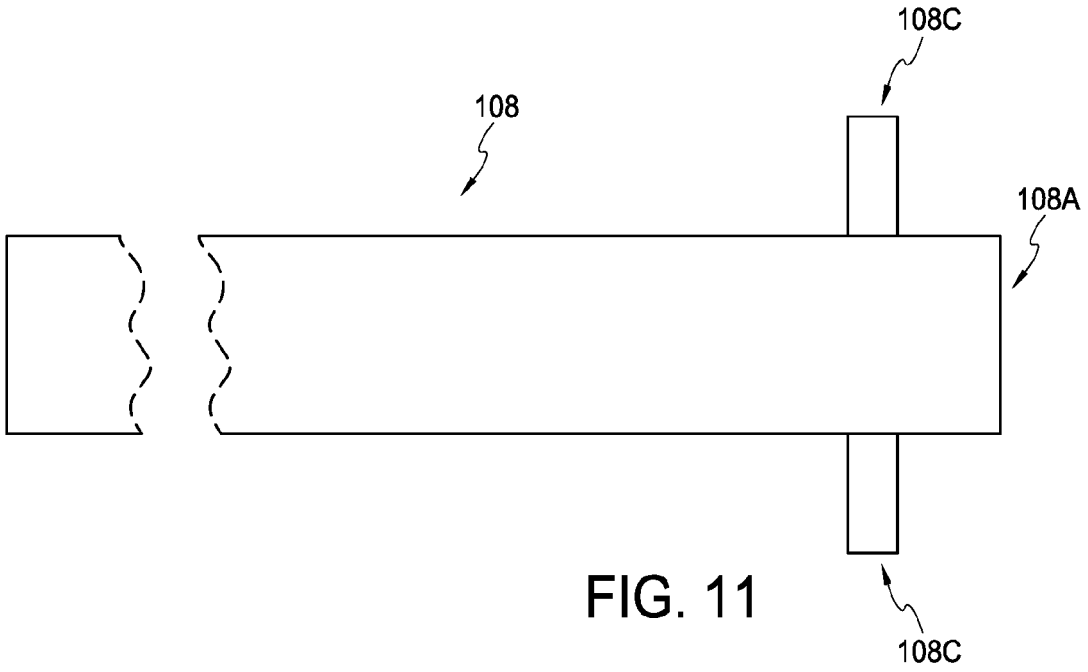
FIG. 11 is a top detail view of the end of a rib as shown in FIG. 10.

Preferably the retainer 194 and the mating surface 212 generally match. For example the mating surface 212 can have a generally convex structure and the retainer 194 can include a generally concave surface. This arrangement permits the retainer 194 to securely receive the mating surface 212 in a fully assembled or locked configuration, which is shown in FIG. 9. In this configuration, the retainer 194 is directly on top of and blocks or otherwise prevents upward movement of the deflectable member 190. Thus, the rib end coupler 150 can provide for secure retention of the pivot member 108C when the hub assembly 116 is locked together.

Stated another way, the retainer 194 is configured to receive the deflectable member 190 in a second configuration of the rib end coupler 150. In the first configuration of the umbrella assembly 116 and of the rib end coupler 150 illustrated by FIG. 8, the upper and lower portions 142, 146 are coupled together and the retainer 194 is disposed away from the deflectable member 190 such that the deflectable member can be deflected in a first direction (e.g., upward or away from the surface 186) to permit the transverse pivot member 108C to move into a coupled position. In the second configuration illustrated in FIG. 9, the upper and lower portions 142, 146 are coupled together and the retainer 194 is disposed immediately adjacent to the deflectable member 190 such that the retainer prevents the deflectable member from being deflected in the first direction by an amount sufficient to permit the transverse pivot member 108C to move out of the coupled position.

The foregoing discussion has been with regard to a single rib end coupler 150. In certain embodiments each rib 108 is retained by a pair of rib end couplers 150. A rib end coupler 150 can be disposed on each side of a corresponding engagement section 154. See, e.g., the location of a pair of deflectable members 190 adjacent to the lower portion 154A of an engagement section as illustrated in FIG. 5. The surface 186 advantageously also extends radially outward of the inclined surface of the deflectable member 190. The radial extent of the surface 186 preferably is at least equal to the diameter of the transverse pivot member 108C. This enables the transverse pivot member 108C to be placed on the surface 186 prior to being urged against the inclined surface of the deflectable member 190. Thus the radially inward force during assembly can be focused onto the inclined surface of the deflectable member 190.

FIGS. 2, 4, and 7-9 illustrate features that facilitate one embodiment for providing the two configurations discussed above. One or more recesses 224 and protrusions 228 are provided that are configured to engage each other in one or both of the configurations. FIG. 4 shows that the recesses 224 in one embodiment includes recesses 224A, 224B disposed along the inner periphery of the lower portion 146. The recess 224A is an upper recess and the recess 224B is a lower recess. FIGS. 2 and 4 show that, in one embodiment, the upper recess 224A has a smaller dimension along a vertical axis (e.g., parallel to the axis through the pole aperture of the hub assembly 116) than the lower recess 224B. The dimensions of the recesses 224A, 224B facilitate the movement form the first, partially assembled configuration to the second, fully assembled configuration, as discussed further below. In one embodiment, the recesses 224 are disposed at the radially inward end of alternating engagement sections 154. For example, two, four, six, or eight pairs of recesses 224 can be provided in various embodiments. The recesses 224 can be disposed in the lower portion 154A of alternating engagement sections 154.

FIGS. 7-9 show various aspects of the protrusions 228. In particular, the protrusions 228 can project away from a lower surface of the upper portion 142. In the illustrated embodiment, the protrusions 228 can be disposed in alternating engagement sections 154. There can be two, four, six or eight protrusions 228 in various embodiments. The protrusions 228 can take any form but preferably are configured to engage the recesses 224A, 224B. In the illustrated embodiment, each of the protrusions 228 includes an elongate member 232 extending away from the lower surface of the upper portion 142 of the hub assembly 116. The lower end of the elongate member 232 can comprise a lateral, e.g., radially outward, portion 236. The member 232 and lateral portion 236 can comprise a hook configuration. The elongate member 232 and lateral portion 236 of one of the protrusions 228 is labeled in FIG. 7, although four identical protrusions 228 are illustrated.

FIGS. 7-8 show that the upper recess 224A and the lateral portion 236 are configured such that the lateral portion 236 only can be partly received in the recess 224A. As noted above, the configuration of FIG. 8 is a partially assembled configuration. In use, the upper portion 142 is advanced toward the lower portion 146. Such advancement causes a lower lateral surface 240 of the lateral portion to engage a wall of the recess 224A. For example the length of the surface 240 along the longitudinal axis of the pole receiving aperture of the hub assembly 116 can be greater than the height of the recess 224A along the longitudinal axis of the pole receiving aperture. The protrusion 228 and the recess 224A are configured such that the protrusion 228 urges the radial lateral portion 236 toward the recess 224A. However the dimension of the recess 224A and the lateral portion 236 permit only partial engagement of the lateral portion 236 with the recess 224A. The lateral portion 236 has an upward facing shoulder that is received in the recess 224A such that the partially assembled configuration of FIG. 8 is secure and will not become inadvertently disengaged.

After all of the transverse pivot member 108C are received within the deflectable members 190 the upper portion 142 and the lower portion 146 can be urged one or both toward the other to the position of FIG. 9. FIG. 9 shows that in the second fully assembled position the recess 224B is configured, e.g., dimensioned along the longitudinal axis of the pole receiving aperture of the hub assembly to receive the lateral portion 236 of the protrusion 228. The height of the recess 224B is equal to or greater than the dimension of the surface 240. This allows the lateral portion 236 to be more fully received in the recess 224B than in was the case in the recess 224A. This arrangement allows the upper and lower portions 142, 146 to be secured to each other.

The foregoing description provides the recesses 224A, 224B on the lower portion 146 and the protrusions 228 on the upper portion 142. The opposite arrangement is also possible, wherein the recesses 224A, 224B are disposed on the upper portion 142 and the protrusions 228 on the lower portion.

The protrusions 228 and recesses 224A, 224B provide a first set of securement devices as discussed above. FIGS. 4-6, and 8-9 show another securement device disposed between the upper 142 and the lower portion 146, e.g., at the hub interface 182. The securement device includes a locking protrusion 268 distinct from the protrusions 228. The securement device includes a second recess 264 configured to mate with the protrusion 268. The securement device including the protrusion 268 and recess 264 can be provided apart from or along with the securement device including the protrusion 228 and recesses 224. The locking protrusion 268 can take any suitable form, for example being elongate and having a tapered member 272 disposed at an end thereof. The tapered member 272 can include a conical section and the elongate member can include a cylindrical portion. The locking protrusion 268 can extend from a surface of the lower portion 146 disposed at or on the hub interface 182. FIGS. 4 and 5 show that some embodiments have a plurality of protrusions 268 that can be arranged at an upper surface of the lower portion 146. The protrusions 268 can be spaced about the lower portion 146, e.g., on alternating portions 158A of the projections 158. The position of the protrusions 268 along the lower portion 158A of the projections 158 can be radially inward of the deflectable members 190.

FIGS. 6-9 show details of the recess 264. The recess 264 is configured to receive the protrusions 268. In the illustrated embodiment, the recess 264 extends between a top surface toward a lower surface of the upper portion 142, e.g., toward the lower portion 146 when the assembly 116 is assembled. The recess 264 can be configured as a passage that extend from the hub interface 182 between the upper and lower portions 142, 146. FIGS. 8 and 9 show that the passage can have a tapered portion 264A disposed between the interface 182 and the top surface of the upper portion 142. The tapered portion 264A can be configured to abut the conical section of the tapered portion 272 of the protrusion 268. The tapered portion 264 can have an inverse taper, for example with the same slope as the tapered portion 272 but with a concave profile. FIG. 8 shows a partially assembled configuration in which the tapered portion 272 rests against the tapered portion 264A of the recess 264. In one embodiment, the recess 264 can be configured to allow the tapered portion 272 to be disposed above the tapered portion 264A. For example, the passage of the recess 264 can have a wide portion 264B at a position between the tapered portion 264A and the top surface of the top portion 142. FIG. 9 shows that the wide portion 264B allow the tapered portion 272 of the protrusion 268 to be disposed above the tapered portion 264A of the recess. In this position, the protrusion 268 is retained within the recess 264. For example, a surface of the protrusion 268 between the tapered portion 272 and the interface 182 can be positioned to abut a surface of the recess 264 located above the tapered portion 264A and facing the top surface of the upper portion 142. Such abutment generally prevents the protrusion 268 from moving from the position of the FIG. 9 toward the position of FIG. 8 or completely out of the recess 268.

The wide portion 264B can have any suitable configuration. For example, the wide portion 264B can have a generally constant width between the tapered portion 264A and the top surface of the upper portion 142. The wide portion 264B of the recess 264 can be substantially cylindrical above the tapered portion 264A.

In one method of assembly, a surface of the tapered member or portion 272 is positioned between the cylindrical portion of the recess 264 and the lower surface of the upper portion 142 of the hub assembly 116. For example the tapered portion 272 can be placed in contact with the tapered portion 264A of the recess 264. When in this position, the transverse pivot member 108C of one or a plurality of ribs can be assembled into the partially assembled hub assembly 116. This position or configuration can also include the protrusion 228 engaging the upper recess or locking recess 224A in the first engagement position discussed above. In one method, a surface of the conical or tapered member or portion 272 is positioned within the cylindrical portion of the passage or recess 264 when the retainer 194 is brought into close proximity with the deflectable member 190. This position or configuration can also include the protrusion 228 engaging the lower recess 224B in the second engagement position discussed above.

Figure 6:
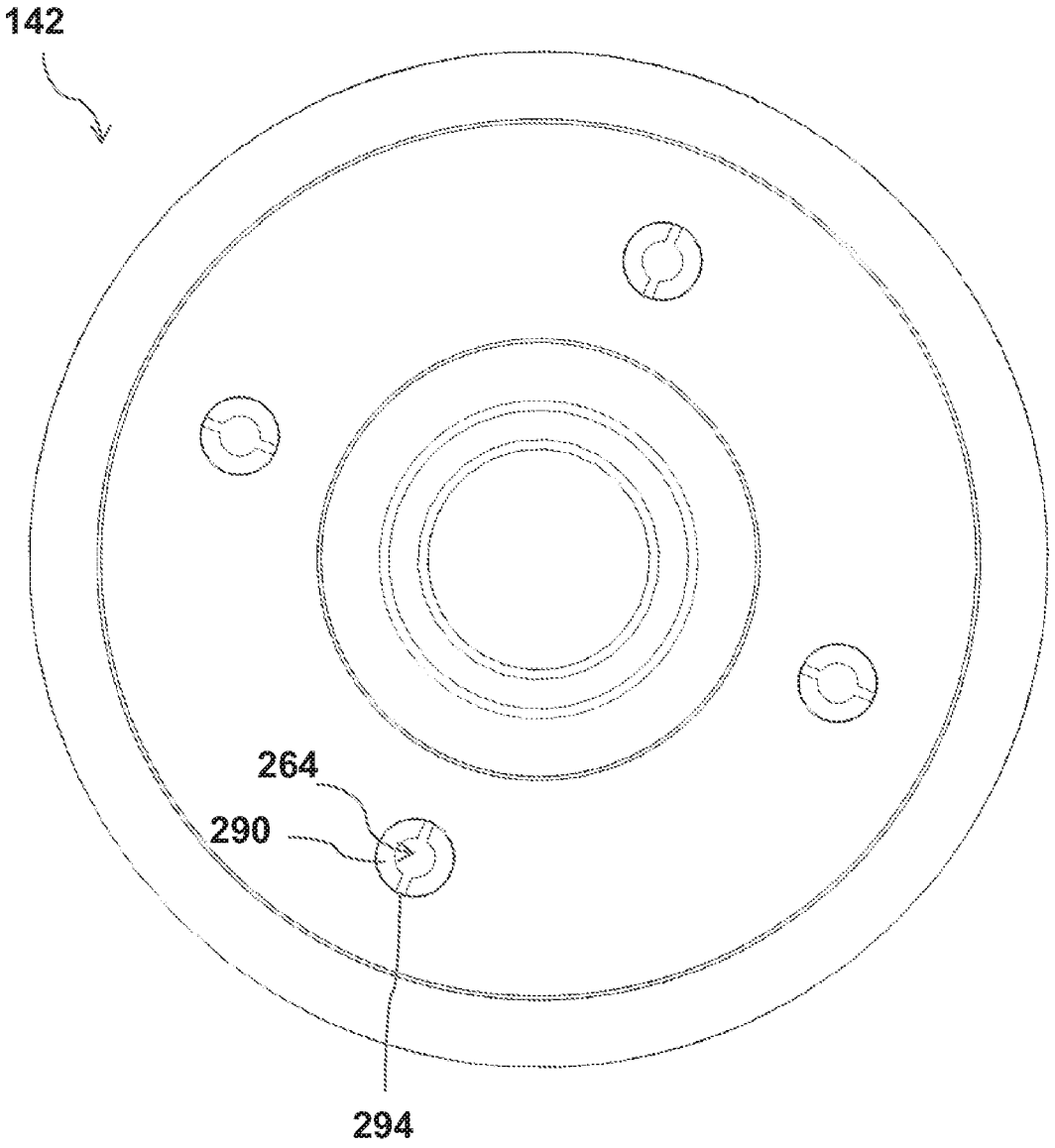
FIG. 6 is a top view of an upper portion of the hub assembly of FIG. 2.

The hub assembly 116 preferably is configured such that the protrusion 228 can be advanced from the tapered portion 264A to the wide portion 264B without requiring a large amount of force. One approach to facilitating assembly in this way is to configure the portion in which the recess 264 is formed (e.g., in the upper portion 142) to change shape as the tapered portion 272 is advanced in the recess 264. For example, in one embodiment the walls 290 surrounding the passage or recess 264 are deflectable upon movement of the hub assembly 116 from a first engagement position (e.g., partially assembled as in FIG. 8) to a second engagement position (e.g., fully assembled as in FIG. 9). Such deflection permits the tapered member or portion 272 to pass through a narrow portion (e.g., the tapered portion 264A) of the passage 264 into an enlarged or wide portion 264B of the passage. FIGS. 6-7 show that one or more slits 294 can be formed in the walls 290. The slits 294 extend in a periphery of the tapered portion 264A. The slits 294 are disposed in a periphery of the tapered or narrow portion 264A of the passage and enables portions thereof to move away from each other to temporarily enlarge the tapered or narrow portion of the passage. In one embodiment, the slits 294 extend from one location in the periphery of the narrow portion 264A through a wall of the upper portion radially away from the narrow portion. The slits 294 can extend to an end 294A disposed at a central open area of the upper portion 142. The slits 294 can extend from two opposed sides of the narrow portion 264A. The slits 294 can extend to an end 294B opposite the end 294A. Other structures could be substituted for the slit 294. For example, the wall 290 could be highly deformable and/or compressible in sections to allow such enlargement.

Among the many advantages of the structures herein is providing a snap-together coupling in connection with the hub assembly 116. The projection 228 is an example of a cantilever member that can extend from one of the upper and lower portions 142, 146 across the interface 182 between the upper and lower portions. The recesses 224A, 224B form a series of recesses disposed on the other of the upper and lower portion 142, 146. The cantilever member has a lateral projection, e.g., in the form of the lateral projection 236 adjacent to a free end thereof. The recesses 224A, 224B are configured to receive the lateral projection of the cantilever member to define a partial or full assembly configuration. These arrangements are capable of being provided by hand force and eliminate the previous use of tools and reduce or minimize the need for rework because even in the partially assembled configuration the pivot members 108C will not pull out of the position between the pivot facing surface 216 and the interface 182.

Further securement of the upper and lower portions 142, 146 can be provided by a plurality of snap together feature 320, 324. The features can include hooks disposed on the upper portion 142 with radial protrusion configured to engage recess disposed on the lower portion 146. The features 320, 324 are preferably configured to be disengaged in the first (partially assembled) configuration discussed above and to be securely engaged in the second (fully assembled) configuration discussed above.

In one embodiment, a substantially continuous inner periphery is provided within a central aperture 332 of the hub assembly 116. The central aperture 332 is that configured to receive the umbrella pole 104 in use. The continuous inner periphery is provided by the projections 228 being received between curved plate-like members 336 disposed opposite the projections 228. For example, if the projections 228 are on the upper portion 142 the members 336 are disposed on the lower portion 146. If the projections 228 are on the lower portion 142 the members 336 are disposed on the upper portion 146. The members 336 are shown on the lower portion 146 in FIGS. 4, 5, 8, and 9. At the upper end of the members 336 a tapered portion is provided into which the projections 228 are receive. This tapered portion helps to guide the projections 228 toward the recesses 224A, 224B. In the vicinity of the recesses 224A, 224B a continuous surface or one with only small gaps is provided between the members 336 and the projections 228 as shown in FIGS. 8 and 9. In this area the members 336 support the projections 228 to reduce or minimize deflections of and potential failure of the projections.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella hub comprising:

an aperture configured to be disposed about an umbrella pole;

an upper portion including a top surface extending between the aperture and an outer periphery of the hub;

a lower portion including a bottom surface extending between the aperture and the outer periphery of the hub;

a first engagement position in which, the upper and lower portions are locked together through a first snap-together coupling and in which the umbrella hub is configured to permit insertion of end portions of umbrella structural members into the hub, the first engagement position being provided by first relative movement of the upper and lower portions of the hub along an axis extending through the aperture; and a second engagement position in which the upper and lower portions are locked together through a second snap-together coupling and in which the umbrella hub is configured to retain, end portions of umbrella structural members within the hub, the second engagement position being provided by second relative movement of the upper and lower portions of the hub along an axis extending through the aperture.

2. The umbrella hub of claim 1, wherein a first locking protrusion is provided on one of the upper and lower portions of the hub to sequentially engage with the first snap-together coupling comprising a first locking recess and with the second snap -together coupling comprising a second locking recess on the other one of the upper and lower portions of the hub and a second locking protrusion is provided on one of the upper and lower portions of the hub to engage with a first locking passage on the other one of the upper and lower portion of the hub.

3. The umbrella hub of claim 2, wherein the first locking protrusion comprises a hook disposed on the upper portion of the hub and projecting below a lower surface of the upper portion to a lateral portion and the first and second locking recesses are each disposed on the lower portion of the hub and are each configured to receive the lateral portion of the hook in one of the first and second engagement positions.

4. The umbrella hub of claim 2, wherein the first locking protrusion comprises a free end having a tapered surface configured to enable the first locking protrusion to be deflected such that the first locking protrusion can engage the first locking recess and the second locking recess.

5. The umbrella hub of claim 1, wherein a first locking protrusion is provided on one of the upper and lower portions of the hub to sequentially engage with the first snap -together coupling comprising a first locking recess and with the second snap-together coupling comprising a second locking recess on the other one of the upper and lower portions of the hub.

6. The umbrella hub of claim 1, wherein a first locking protrusion is provided on one of the upper and lower portions of the hub to engage with a first locking passage on the other one of the upper and lower portion of the hub.

7. An umbrella hub comprising, an aperture configured to be disposed about an umbrella pole;

an upper portion including a top surface extending between the aperture and an outer periphery of the hub;

a lower portion including a bottom surface extending between the aperture and the outer periphery of the hub;

a first engagement position configured to permit insertion of end portions of umbrella structural members into the hub, the first engagement position being provided by first relative movement of the upper and lower portions of the hub along an axis extending through, the aperture; and a second engagement position configured to retain end portions of umbrella structural members within the hub, the second engagement position being provided by second relative movement of the upper and lower portions of the hub along an axis extending through the aperture;

wherein a first locking protrusion is provided on the upper portion of the hub to engage with a first locking recess on the lower portion of the hub and a second locking protrusion is provided on one of the upper and lower portions of the hub to engage with a second locking recess on the other one of the upper and lower portions of the hub;

wherein the first locking protrusion comprises a hook projecting below a lower surface of the upper portion to a lateral portion and the first locking recess is configured to receive the lateral portion of the hook in one of the first and, second engagement positions; and wherein the first locking recess comprises a first lateral recess being located at a first elevation of the lower portion of the hub to receive the hook in the first engagement position and a second lateral recess being located at a second elevation of the lower portion of the hub to receive the hook in the second engagement position, the first elevation being disposed between the second elevation and the lower surface of the upper portion of the hub when the hub is assembled.

8. An umbrella hub comprising:, an aperture configured to be disposed about an umbrella pole;

an upper portion including a top surface extending between the aperture and an outer periphery of the hub;

a lower portion including a bottom surface extending between the aperture and the outer periphery of the hub;

a first engagement position configured to permit insertion of end portions of umbrella structural members into the hub, the first engagement position being provided by first relative movement of the upper and lower portions of the hub along an axis extending through the aperture; and a second engagement position configured to retain end portions of umbrella structural members within the hub, the second engagement position being provided by second relative movement of the upper and lower portions of the hub along an axis extending through the aperture;

wherein a first locking protrusion is provided on, one of the upper and lower portions of the hub to engage with, a first locking recess on the other one of the upper and lower portions of the hub and a second locking protrusion is provided on the lower portion of the hub to engage with a second locking recess on the upper portion of the hub; and wherein the second locking protrusion comprises a tapered member disposed above an upper surface of the lower portion and the second locking recess comprises a passage extending between the lower surface of the upper hub portion and the upper surface of the upper portion.

9. The umbrella hub of claim 8, wherein the passage includes a tapered portion and a cylindrical portion, the tapered portion being disposed between the cylindrical portion and the lower surface of the upper portion.

10. The umbrella hub of claim 9, wherein a surface of the tapered member is positioned between the cylindrical portion of the passage and the lower surface of the upper portion of the hub when the first locking protrusion and the first locking recess are engaged and the hub is in the first engagement position.

11. The umbrella hub of claim 10, wherein a surface of the conical member is positioned within the cylindrical portion of the passage when the hub is in the second engagement position.

12. The umbrella hub of claim 11, wherein a lower surface of the cylindrical portion of the passage is positioned below a lower surface of the tapered member when the hub is in the second engagement position.

13. The umbrella hub of claim 8, wherein walls surrounding the passage are deflectable upon movement of the hub from the first engagement position to the second engagement position, such deflection permitting the tapered member to pass through a narrow portion of the passage into an enlarged portion of the passage.

14. The umbrella hub of claim 13, wherein a periphery of the narrow portion of the passage is configured to enable portions thereof to move away from each other to temporarily enlarge the narrow portion of the passage.

15. The umbrella hub of claim 14, wherein a slit is disposed at the periphery to provide for such movement.

16. An umbrella hub comprising:

an upper portion including a top surface extending toward an outer periphery of the hub;

a lower portion including a bottom surface extending toward the outer periphery of the hub;

a snap-together coupling comprising a cantilever member extending from one of the upper and lower portions across an interface between the upper and lower portions and a series of recesses disposed on the other of the upper and lower portion, the recesses being aligned but spaced apart along a direction disposed transverse to the interface;

wherein the cantilever member having a lateral portion adjacent to a free end thereof and the recesses are configured to receive the lateral portion of the cantilever member to define a partial or full assembly configuration.

17. The umbrella hub of claim 16, further comprising a central umbrella pole aperture disposed therethrough, the cantilever members being disposed along the umbrella pole aperture.

18. The umbrella hub of claim 17, wherein at least one of the recesses of the series of recesses is disposed on an inner wall of an engagement section of the hub.

19. An umbrella hub assembly comprising:

a plurality of elongate ribs, each rib having an inner end, an outer end, and a body extending therebetween along a longitudinal axis, the inner end having a transverse pivot member extending away from the longitudinal axis;

a hub assembly comprising:

an upper portion having a lower surface partially defining a hub interface;

a lower portion having an upper surface partially defining the hub interface;

a rib end coupler disposed at the hub interface, the rib end coupler comprising a deflectable member configured to be deflected to receive the transverse pivot member of one of the ribs in a first configuration of the rib end coupler and a retainer configured to receive the deflectable member in a second configuration of the, rib end coupler;

wherein in the first configuration of the rib end coupler, the upper and lower portions are coupled together and the deflectable member is disposed in a pathway between an outer periphery of a portion of the hub and a coupled position and the retainer is disposed away from the deflectable member such that the deflectable member can be deflected in a first direction out of the pathway to permit the transverse pivot member to move into the coupled position; and wherein in the second configuration, the upper and lower portions are coupled together and the retainer is disposed immediately adjacent to the deflectable member such that the retainer prevents the deflectable member from being deflected in the first direction by a distance sufficient to permit the transverse pivot member to move out of the coupled position.

20. The umbrella hub assembly of claim 19, wherein the rib end coupler is configured to enable the deflectable member to be deflected by the transverse pivot member of the ribs.

21. A method of assembling umbrella components, comprising:

advancing a first portion of an umbrella hub toward a second portion of the umbrella hub to a first position in which the first and second portions of the umbrella hub are engaged for assembly;

inserting an end of a rib laterally into an engagement portion of the hub to dispose a pivot member of the end of the rib adjacent a rib end coupler disposed on the first and second portions of the umbrella hub;

actuating a deflectable member of the rib end coupler on the first portion to expand a gap in the rib end coupler to permit the pivot member to be advanced, into a pivoting space in the rib end coupler; and locking the first portion of the umbrella hub to the second portion in a second position of the umbrella hub to position a retainer of the rib end coupler on the second portion to prevent the gap in the rib end coupler from expanding sufficiently to retain the pivot member in the rib end coupler.

22. The method of claim 21, wherein the actuating comprises pressing the pivot member against a radially outer face of the rib end coupler.

23. The method of claim 21, wherein the locking comprises advancing a tapered member projecting from one the first and second portion of the umbrella hub through a narrow locking passage disposed on the other of the first and second portions of the umbrella hub.

24. The method of claim 21, wherein the locking comprises advancing a hook projecting from one the first and second portion of the umbrella hub into a recess disposed on the other of the first and second portions of the umbrella hub.

25. The method of claim 22, wherein the locking comprises advancing a tapered member projecting from one the first and second portion of the umbrella hub through a narrow locking passage disposed on the other of the first and second portions of the umbrella hub.

26. The method of claim 24, wherein the advancing comprises pressing a tapered face of the hook against a surface of the one of the first and second portion from which the hook is not projecting to cause the hook to deflect such that the hook can engage the one of the first and second portion from which the hook is not projecting.

27. An umbrella hub comprising:

an aperture configured to be disposed about an umbrella pole;

an upper portion including a top surface extending between the aperture and an outer periphery of the hub;

a lower portion including a bottom surface extending between the aperture and the outer periphery of the hub;

a first engagement position configured to permit insertion of end portions of umbrella structural members into the hub, the first engagement position being provided by first relative movement of the upper and lower portions of the hub along an axis extending through the aperture; and a second engagement position configured to retain end portions of umbrella structural members within the hub, the second engagement position being provided by second relative movement of the upper and lower portions of the hub along an axis extending through the aperture, wherein a first locking protrusion is provided on one of the upper and lower portions of the hub to engage with a first locking recess on the other of the upper and lower portion of the hub and a second locking protrusion is provided on one of the upper and lower portions of the hub to engage with a second locking recess on the other of the upper and lower portion of the hub; and wherein the second locking protrusion, comprises [a] a tapered member disposed above an upper surface of the lower portion and the second locking recess comprises a passage extending between, the lower surface of the upper portion and the upper surface of the upper portion or [b] a tapered member is disposed below a lower surface of the upper portion and the second locking recess comprises a passage extending between the upper surface of the lower portion and the lower surface of the lower portion if the tapered member is provided on the upper portion.

* * * * *